US010151157B2

(12) United States Patent
Guerra

(10) Patent No.: US 10,151,157 B2
(45) Date of Patent: Dec. 11, 2018

(54) KICKER AND TRANSFER ASSEMBLY FOR A TUBULAR HANDLING SYSTEM

(71) Applicant: FORUM US, INC., Houston, TX (US)

(72) Inventor: Gerardo Guerra, Houston, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 15/392,460

(22) Filed: Dec. 28, 2016

(65) Prior Publication Data

US 2018/0179835 A1 Jun. 28, 2018

(51) Int. Cl.
*E21B 19/14* (2006.01)
*E21B 19/15* (2006.01)

(52) U.S. Cl.
CPC ..... *E21B 19/15* (2013.01); *E21B 19/14* (2013.01)

(58) Field of Classification Search
CPC ..... E21B 19/15; E21B 19/155; E21B 19/16; E21B 19/18; E21B 19/20; E21B 19/14
USPC ..... 414/22.51–22.71
See application file for complete search history.

(56) References Cited

U.S. PATENT DOCUMENTS 3,780,883 A * 12/1973 Brown ..... E21B 19/15 175/85
4,379,676 A * 4/1983 Frias ..... E21B 19/15 414/22.61
6,079,925 A * 6/2000 Morgan ..... E21B 19/14 414/22.57
6,899,510 B2 5/2005 Morelli et al.
7,021,880 B2 4/2006 Morelli et al.
7,473,065 B2 * 1/2009 Wells ..... E21B 19/155 414/22.57
8,033,779 B2 * 10/2011 Gerber ..... E21B 19/15 14/71.1
9,624,740 B2 * 4/2017 Molski ..... E21B 19/15
2003/0123955 A1 * 7/2003 Eastcott ..... B60P 3/00 414/22.54
2011/0044787 A1 * 2/2011 Fikowski ..... E21B 19/155 414/22.59
2015/0259992 A1 9/2015 Forbes et al.

FOREIGN PATENT DOCUMENTS

CA 2224638 A1 6/1999
WO 2011/011888 A1 2/2011
WO 2014/172690 A2 10/2014
WO 2016/168482 A1 10/2016

OTHER PUBLICATIONS

International Search Report and Written Opinion dated Jan. 9, 2018, corresponding to Application No. PCT/US2017/054303.

* cited by examiner

*Primary Examiner* — Lynn E Schwenning
(74) *Attorney, Agent, or Firm* — Patterson & Sheridan, L.L.P.

(57) ABSTRACT

A tubular handling system has a trough with two exterior channels and an interior channel disposed between the two exterior channels. The two exterior channels and the interior channel are disposed along a longitudinal length of the trough and are configured to support at least one tubular. The tubular handling system also has a set of exterior kickers configured to move the tubular from one of the exterior channels to the interior channel and from one of the exterior channels to a position out of the trough. The tubular handling system has an interior kicker configured to move the tubular from the interior channel to one of the exterior channels.

19 Claims, 10 Drawing Sheets

KICKER AND TRANSFER ASSEMBLY FOR A TUBULAR HANDLING SYSTEM

BACKGROUND

Field

Embodiments of the disclosure relate to tubular handling systems, such as a catwalk, for conveying pipe to a drill floor from a lower section of a drilling rig or drill site, and returning pipe to the lower section from the drill floor. Specifically, embodiments of the disclosure relate to a kicker and transfer assembly that is used to transfer pipe into and out of the tubular handling system.

Description of the Related Art

In a drilling operation or rig work-over operation, pipe, casing, or other tubulars used during the operation are often stored and supplied from a pipe deck at a level that is lower than the drill floor. Operators typically use a "tubular handling system," such as a catwalk, to convey the pipe from the pipe deck to the drill floor, and to return pipe to the pipe deck after use. Tubular handling systems have a trough that holds the pipe when being transferred to and from the drill floor. Since most tubular handling systems have only a single channel along the trough within which the pipe resides, the amount of pipe that can be transferred in one transfer cycle via the trough is limited by the length of the trough.

Accordingly, it would be useful to have a tubular handling system that can convey more tubulars per transfer cycle.

SUMMARY

In one embodiment, a tubular handling system is provided. The tubular handling system has a trough with two exterior channels and an interior channel disposed between the two exterior channels. The two exterior channels and the interior channel are disposed along a longitudinal length of the trough and are configured to support at least one tubular. The tubular handling system also has an exterior kicker configured to move the tubular from one of the exterior channels to the interior channel or from one of the exterior channels to a position out of the trough. The tubular handling system further has an interior kicker configured to move the tubular from the interior channel to one of the exterior channels.

In another embodiment, a tubular handling system is provided. The tubular handling system has a trough, a first kicker, a second kicker, and a third kicker. The first kicker has a pipe receiving surface that is inclined in a first direction. The second kicker has a pipe receiving surface that is substantially horizontal. The third kicker has a pipe receiving surface that is inclined in a second direction opposite the first direction. The pipe receiving surfaces of the first kicker, the second kicker, and the third kicker are each independently movable relative to the trough between an extended position and a retracted position.

In another embodiment, a kicker and transfer assembly is provided. The kicker and transfer assembly has an interior kicker and a set of exterior kickers having a first kicker, a second kicker, and a third kicker. The interior kicker is disposed adjacent to the set of exterior kickers, and the interior kicker is movable toward the set of exterior kickers in a substantially inclined direction. The first kicker in the set of exterior kickers has a pipe receiving surface that is inclined in a first direction. The second kicker in the set of exterior kickers has a pipe receiving surface that is substantially horizontal. The third kicker in the set of exterior kickers has a pipe receiving surface that is inclined in a second direction opposite the first direction. The first kicker, the second kicker, and the third kicker are each independently movable in a substantially vertical direction.

BRIEF DESCRIPTION OF THE DRAWINGS

The appended drawings illustrate only typical embodiments and are therefore not to be considered limiting of the scope of the disclosure.

DETAILED DESCRIPTION

Figure 1:
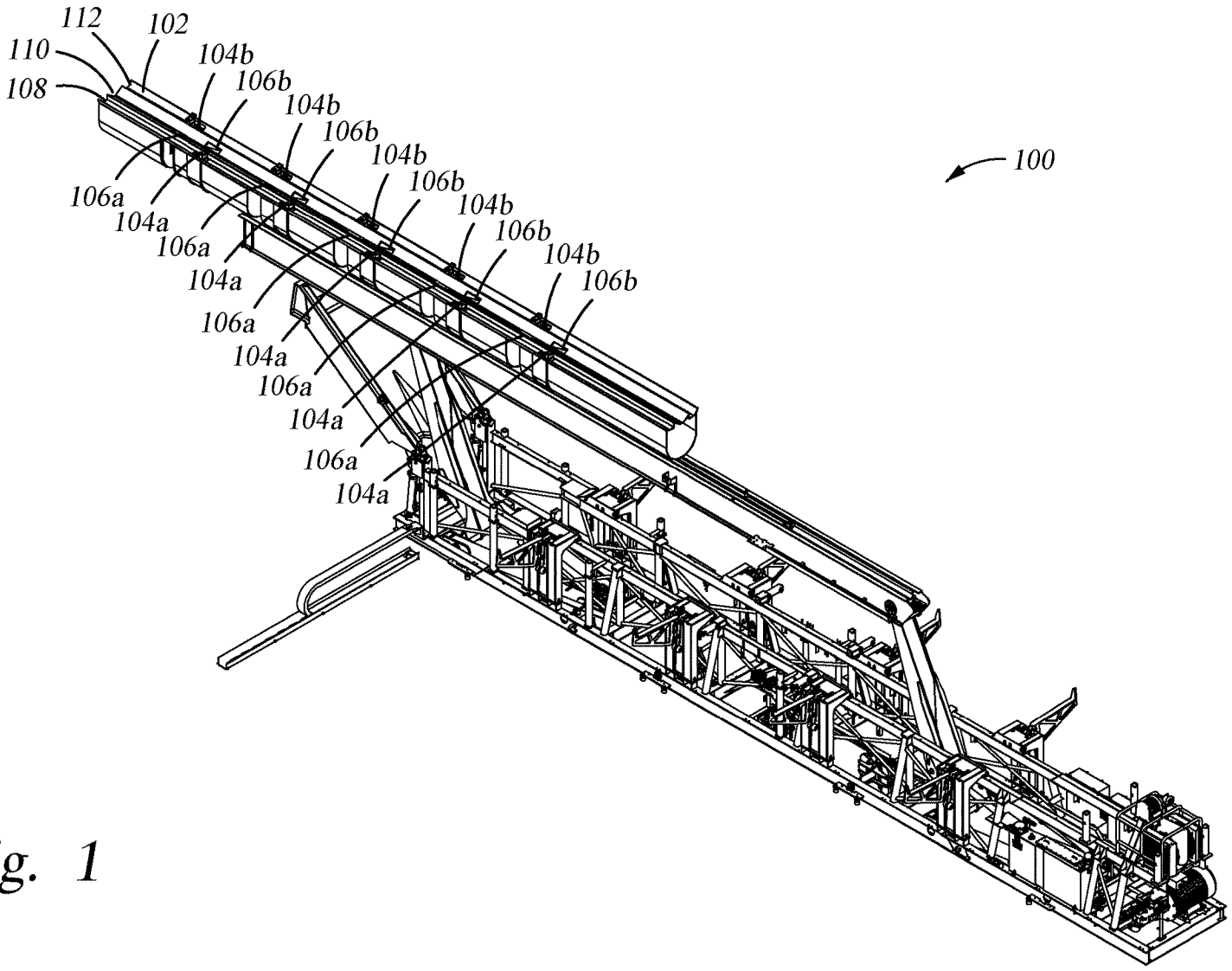
FIG. 1 shows an embodiment of a tubular handling system having a kicker and transfer assembly.

FIG. 1 shows an embodiment of a tubular handling system 100 having a kicker and transfer assembly. As described herein and shown in the drawings, the tubular handling system 100 is as a catwalk. However, the embodiments described herein are not limited to use with a catwalk, but may be used with other types of tubular handling systems for handling and moving tubulars.

In FIG. 1, the tubular handling system 100 has a trough 102 that can be raised and lowered relative to a base for delivering pipe to a rig floor from a pipe deck, and returning pipe from the rig floor to the pipe deck. The trough 102 has three, substantially parallel channels, 108, 110, 112, extending along the longitudinal length of the trough 102. An interior channel 110 is disposed between two exterior channels 108, 112. Each channel 108, 110, 112 is configured to support at least one tubular (e.g., a pipe).

The kicker and transfer assembly in FIG. 1 includes a plurality of interior kickers 106*a*, 106*b* and a plurality of sets of exterior kickers 104*a*, 104*b* for transferring pipe between the channels 108, 110, 112 and for removing pipe from the trough 102. The plurality of interior kickers 106*a*, 106*b* are spaced apart along the interior channel 110, and are configured to move the tubular from the interior channel 110 to one of the exterior channels 108, 112. The plurality of sets of exterior kickers 104*a*, 104*b* are spaced apart along the two exterior channels 108, 112, and are configured to move the tubular from one of the exterior channels 108, 112 to the interior channel 110 or out of the trough 102.

Figure 2:
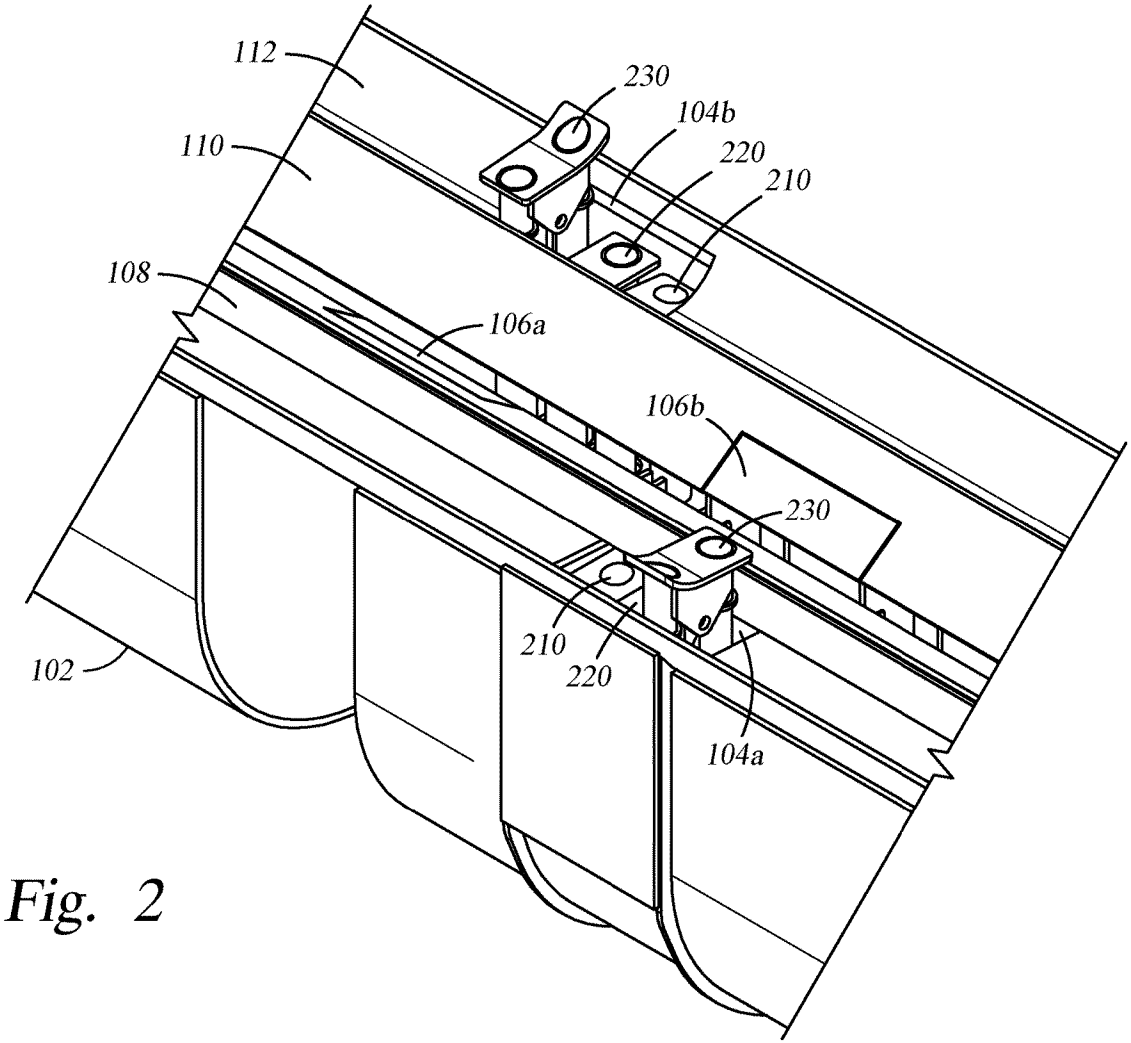
FIG. 2 shows an enlarged sectional view of the kicker and transfer assembly in the tubular handling system shown in FIG. 1.

FIG. 2 shows an enlarged sectional view of the kicker and transfer assembly shown in the trough 102 of the tubular handling system 100 in FIG. 1. A first set of exterior kickers 104*a* is located in a first exterior channel 108 of the trough 102. A second set of exterior kickers 104*b* is located in a second exterior channel 112 of the trough 102. A first interior kicker 106*a* is located in the interior channel 110 adjacent to the second set of exterior kickers 104*b*. A second interior kicker 106*b* is located in the interior channel 110 of the trough 102 adjacent to the first set of exterior kickers 104*a*. Each set of exterior kickers 104*a*, 104*b* includes a loader kicker 230 (or first kicker), a transfer kicker 220 (or second kicker), and an unloader kicker 210 (or third kicker).

Figure 3A:
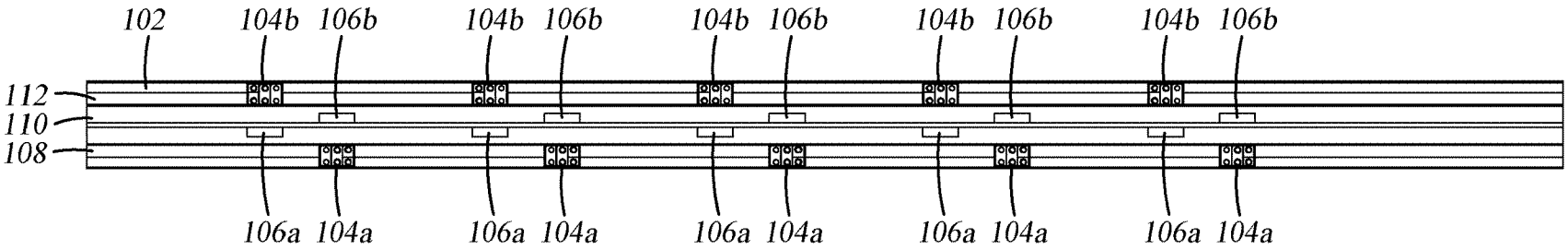
FIG. 3A shows a top view of an embodiment of a trough of the tubular handling system shown in FIG. 1.
Figure 3B:
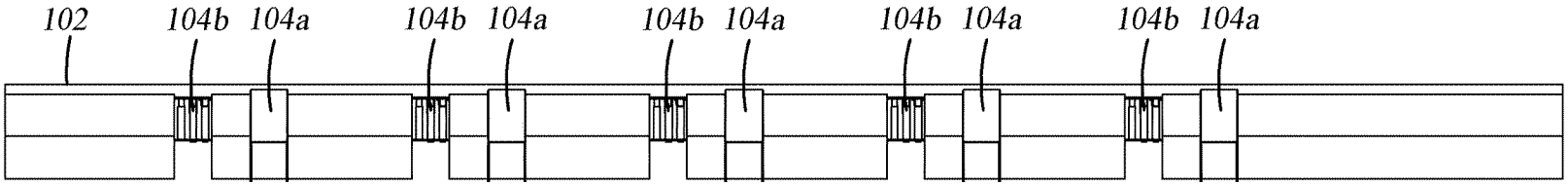
FIG. 3B shows a side view of an embodiment of the trough of the tubular handling system shown in FIG. 1.

FIG. 3A shows a top view of the trough 102 from FIG. 1. As shown, the sets of exterior kickers 104*a* are in the first exterior channel 108. The sets of exterior kickers 104*b* are in the second exterior channel 112. The interior kickers 106*a*, 106*b* are in the interior channel 110. FIG. 3B shows a side view of the trough 102 from FIG. 1, showing several sets of exterior kickers 104*a*, 104*b* spaced apart along the longitudinal length of the trough 102.

Figure 4:
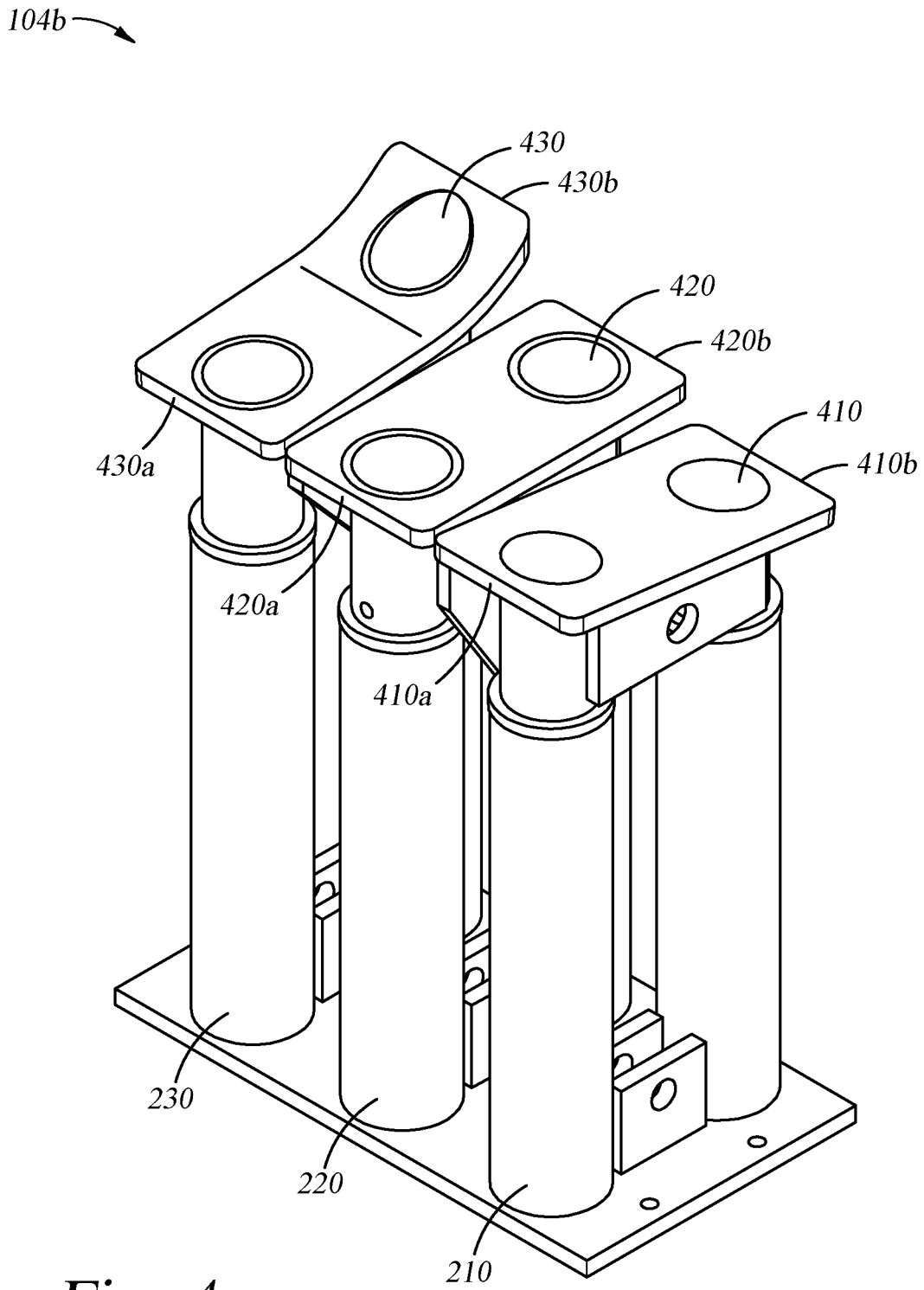
FIG. 4 shows an embodiment of a set of exterior kickers of the kicker and transfer assembly.

FIG. 4 shows an embodiment of a set of exterior kickers 104*b* of the kicker and transfer assembly. The set of exterior kickers 104*b* shown in FIG. 4, which are disposed in the second exterior channel 112 of the trough 102 operate in a substantially similar manner as the set of exterior kickers 104*a* placed on the opposite side of the trough 102 from the set of kickers 104*b* in the first exterior channel 108. The loader kicker 230, the transfer kicker 220, and the unloader kicker 210 are all shown in a retracted state in FIG. 4.

The loader kicker 230 has a partially curved pipe receiving surface 430 that curves upward at the second end 430*b*. The pipe receiving surface 430 of the loader kicker 230 is positioned in an inclining angle from a first end 430*a* to a second end 430*b*, such that it inclines in a first direction. The loader kicker 230 is extended when a pipe is loaded into the interior channel 110 of the trough 102 from the second exterior channel 112.

The transfer kicker 220 has a substantially flat pipe receiving surface 420 that is substantially horizontal (e.g. does not incline or decline) from a first end 420*a* to a second end 420*b*. The transfer kicker 220 may be extended when a pipe is transferred from the interior channel 110 into the second exterior channel 112.

The unloader kicker 210 has a substantially flat pipe receiving surface 410 that is positioned with a declining angle from a first end 410*a* to a second end 410*b*. The pipe receiving surface 140 inclines in a second direction that is opposite the first direction in which the pipe receiving surface 430 of the loader kicker 230 inclines. The unloader kicker 210 is extended when a pipe is transferred out of the second exterior channel 112, thus exiting the trough 102.

In one embodiment, the set of exterior kickers 104*a*, 104*b* may be configured such that the pipe receiving surfaces 430, 420, and 410 of the loader kicker 230, the transfer kicker 220, and the unloader kicker 210, respectively, are each independently movable relative to the trough 120 between an extended position and a retracted position in a substantially vertical direction. In one embodiment, the pipe receiving surfaces 430, 420, and 410 of the loader kicker 230, the transfer kicker 220, and the unloader kicker 210, respectively, may be configured to move along a vertical path while maintaining engagement with a tubular. In one embodiment, the set of exterior kickers 104*a*, 104*b* may be configured such that none of the pipe receiving surfaces 430, 420, and 410 of the loader kicker 230, the transfer kicker 220, and the unloader kicker 210, respectively, in a single set of exterior kickers 104*a*, 104*b* can move at the same time. In one embodiment, the loader kicker 230, the transfer kicker 220, and the unloader kicker 210 may be extended and/or retracted by mechanically, electrically, hydraulically, and/or pneumatically powered devices.

As shown in FIG. 4, the loader kicker 230, the transfer kicker 220, and the unloader kicker 210 may be extended and retracted between an extended position and a retracted position by a linear actuator, such as a piston/cylinder assembly.

Figure 5A:
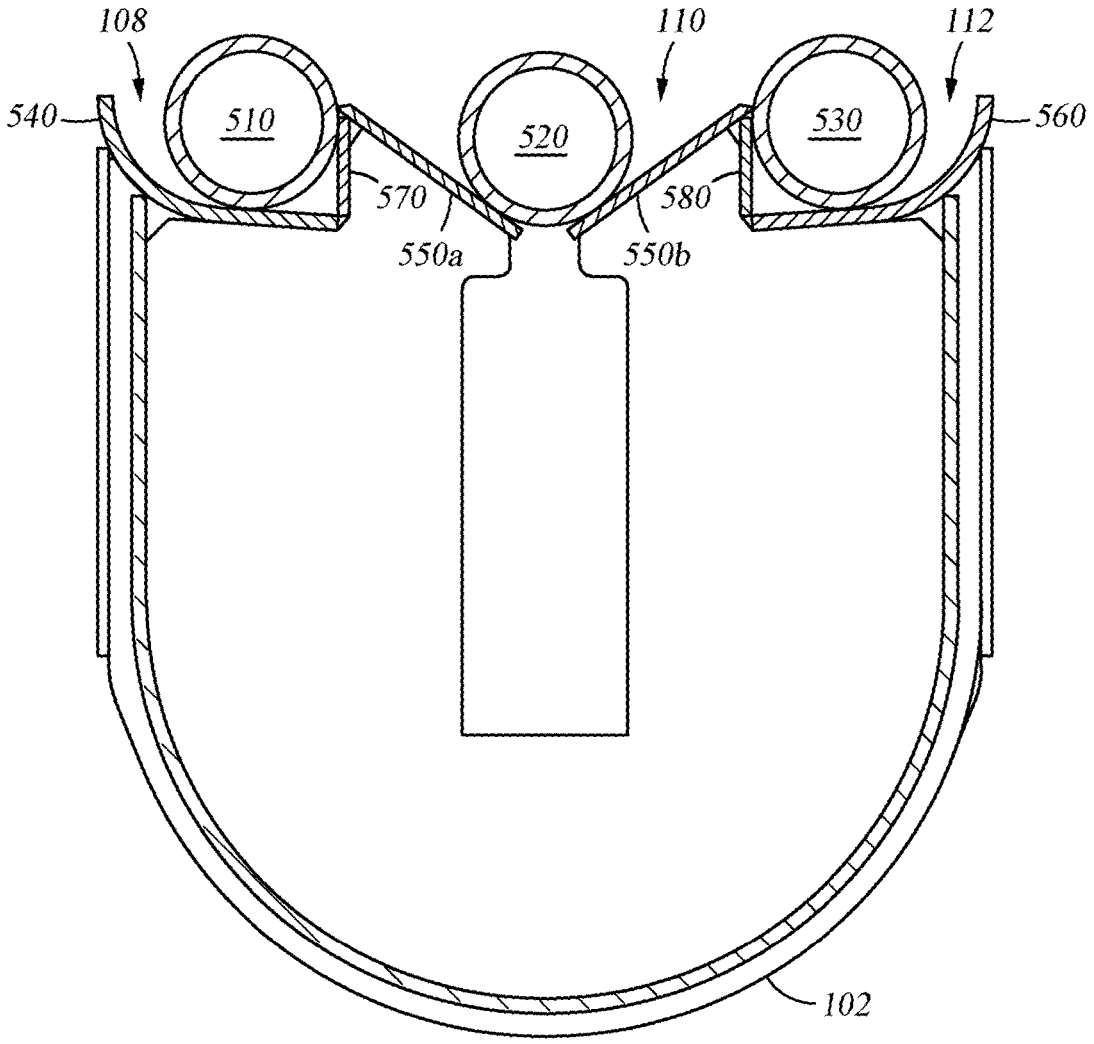
FIGS. 5A, 5B, and 5C show embodiments of a cross-section of a trough of a tubular handling system at different locations along the trough.

FIG. 5A shows an embodiment of a cross-section of the trough 102 at a location along the longitudinal length of the trough 102 where there are no kickers. Each channel 108, 110, and 112 of the trough 102 can hold one or more pipes 510, 520, and 530 respectively. The interior channel 110 is located between the first exterior channel 108 and the second exterior channel 112.

The interior channel 110 is formed by two surfaces 550*a* and 550*b* each angled downward and toward the other to form a "V" shape. A pipe 520 in the interior channel 110 rests in the "V" shape. The first exterior channel 108 is formed by a vertical surface 570, and a surface 540 having a flat portion angled slightly downward from the exterior of the trough 102 toward the interior of the trough 102 and a curved portion that curves upward toward the exterior of the trough 102. The pipe 510 in the first exterior channel 108 is supported by the surfaces 540, 570. The second exterior channel 112 is formed by a vertical surface 580, and a surface 560 having a flat portion angled slightly downward from the exterior of the trough 102 toward the interior of the trough 102 and a curved portion that curves upward toward the exterior of the trough 102. The pipe 530 in the second exterior channel 112 is supported by the surfaces 560, 580.

In this embodiment, surfaces 540, 570, and 550*a* are a mirror image of surfaces 560, 580, and 550*b* respectively, however the disclosure is not limited to this embodiment, and the surfaces 540, 570, 550*a*, 560, 580, and 550*b* may have other sizes shapes. Additionally, in this embodiment, the cross-section of the trough 102 has three channels 108, 110, and 112 that can each hold one or more pipes along the longitudinal length of the channels 108, 110, 112. However, the disclosure is not limited to this embodiment, and the trough 102 may have one, two, three, four, five, or more channels for conveying pipe.

Figure 5B:
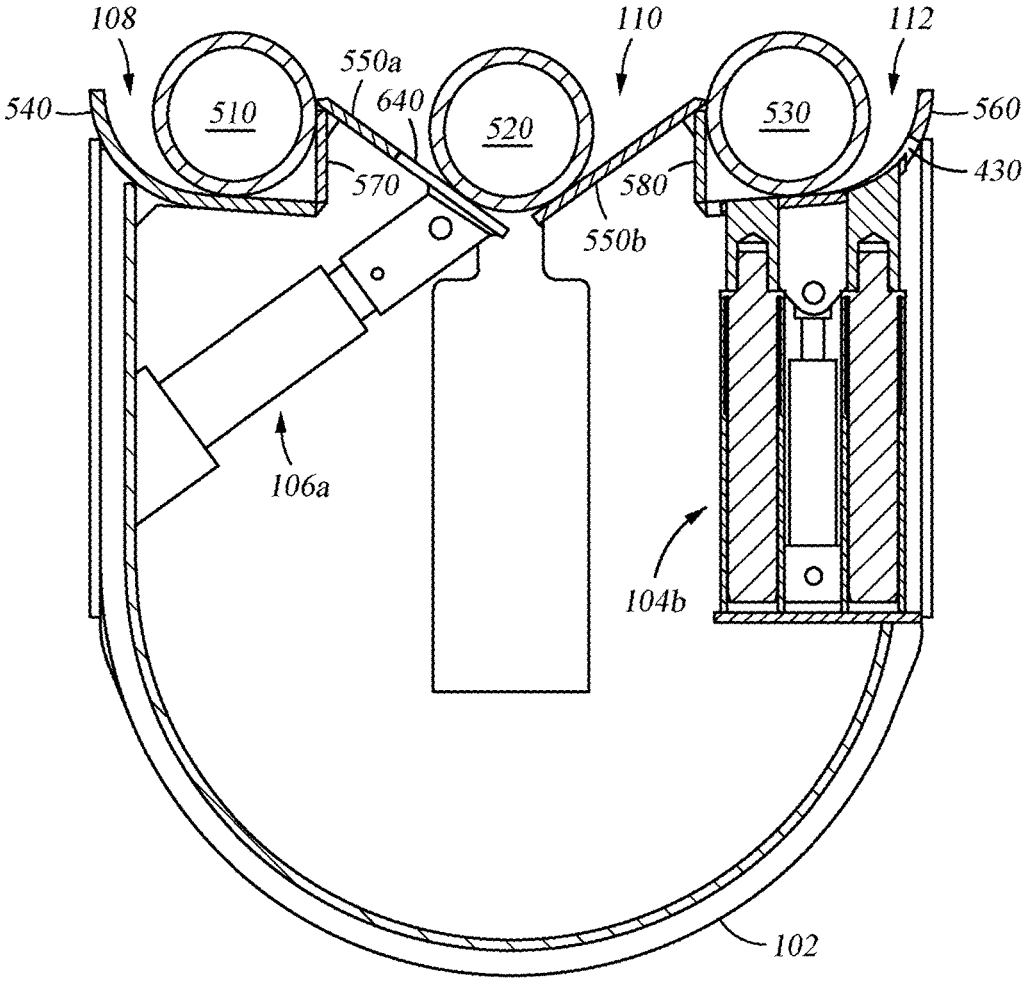

FIG. 5B shows an embodiment of a cross-section of the trough 102 at a location along the longitudinal length of the trough 102 having an interior kicker 106*a* and a set of exterior kickers 104*b*. The interior kicker 106*a* and the set of exterior kickers 104*b* are in the retracted state. The pipes 510, 520, and 530 are at rest in each of the channels 108, 110, and 112 respectively.

As shown, when the interior kicker 106*a* is in the retracted state, a shoe surface 640 of the interior kicker 106*a* lies substantially flush with the surface 550*a* of the interior channel 110, such that the pipe 520 rests against shoe surface 640. The shoe surface 640 of the interior kicker 106*a* is inclined in substantially the same direction as the pipe receiving surface 410 of the unloader kicker 210 in the set of exterior kickers 104*b*. When each kicker in the set of exterior kickers 104*b* is in the retracted state as shown, the pipe receiving surface 430 of the loader kicker 230 lies substantially flush with the surface 560 of the second exterior channel 112, such that the pipe 530 rests on the pipe receiving surface 430 of the loader kicker 230.

The pipe receiving surface 420 of the transfer kicker 220 and the pipe receiving surface 410 of the unloader kicker 210 of the set of exterior kickers 104*b* may lie at least partially flush with and/or at least partially below the surface 560 of the second exterior channel 112. The pipe 530 may only rest on the portions of the pipe receiving surfaces 410, 420, 430 that are substantially flush with the surface 560 of the second exterior channel 112. In one embodiment, the pipe receiving surfaces 410, 420, 430 may be disposed below the surface 560 of the second exterior channel 112 when the set of exterior kickers 104*b* are fully retraced such that the pipe 530 is supported only by the surface 560 of the second exterior channel 112.

Figure 5C:
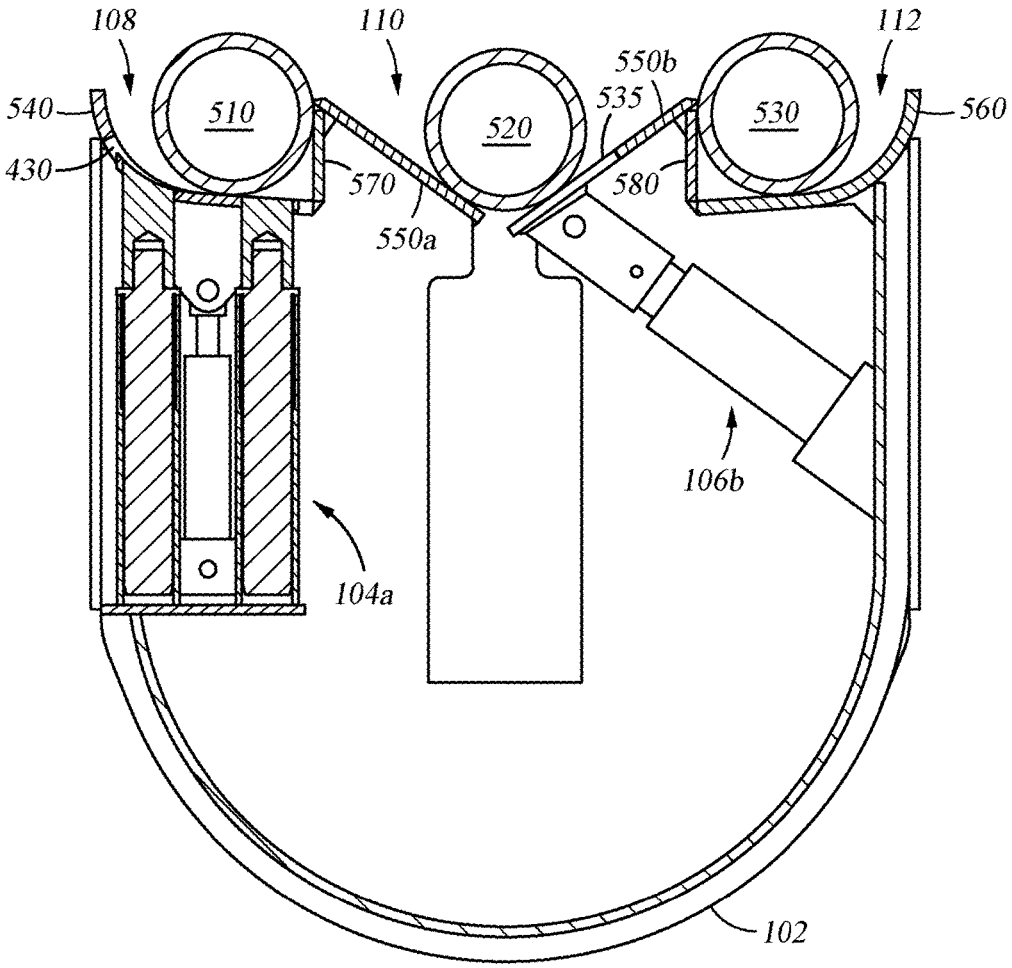

FIG. 5C shows an embodiment of a cross-section of the trough 102 at a location along the longitudinal length of the trough 102 having an interior kicker 106*b* and a set of exterior kickers 104*a*. The interior kicker 106*b* and the set of exterior kickers 104*a* are in the retracted state. The pipes 510, 520, and 530 are at rest in each of the channels 108, 110, and 112 respectively.

As shown, when the interior kicker 106*b* is in the retracted state, a shoe surface 535 of the interior kicker 106*b* lies substantially flush with the surface 550*b* of the interior channel 110, such that the pipe 520 rests against shoe surface 535. The shoe surface 535 of the interior kicker 106*b* is inclined in substantially the same direction as the pipe receiving surface 410 of the unloader kicker 210 in the set of exterior kickers 104*a*. When each kicker in the set of exterior kickers 104*a* is in the retracted state as shown, the pipe receiving surface 430 of the loader kicker 230 lies substantially flush with the surface 540 of the first exterior channel 108, such that the pipe 510 rests on the pipe receiving surface 430 of the loader kicker 230.

The pipe receiving surface 420 of the transfer kicker 220 and the pipe receiving surface 410 of the unloader kicker 210 of the set of exterior kickers 104*a* may lie at least partially flush with and/or at least partially below the surface 540 of the first exterior channel 108. The pipe 510 may only rest on the portions of the pipe receiving surfaces 410, 420, 430 that are substantially flush with the surface 540 of the first exterior channel 108. In one embodiment, the pipe receiving surfaces 410, 420, 430 may be disposed below the surface 540 of the first exterior channel 108 when the set of exterior kickers 104*a* are fully retraced such that the pipe 510 is supported only by the surface 540 of the first exterior channel 108.

Figure 6A:
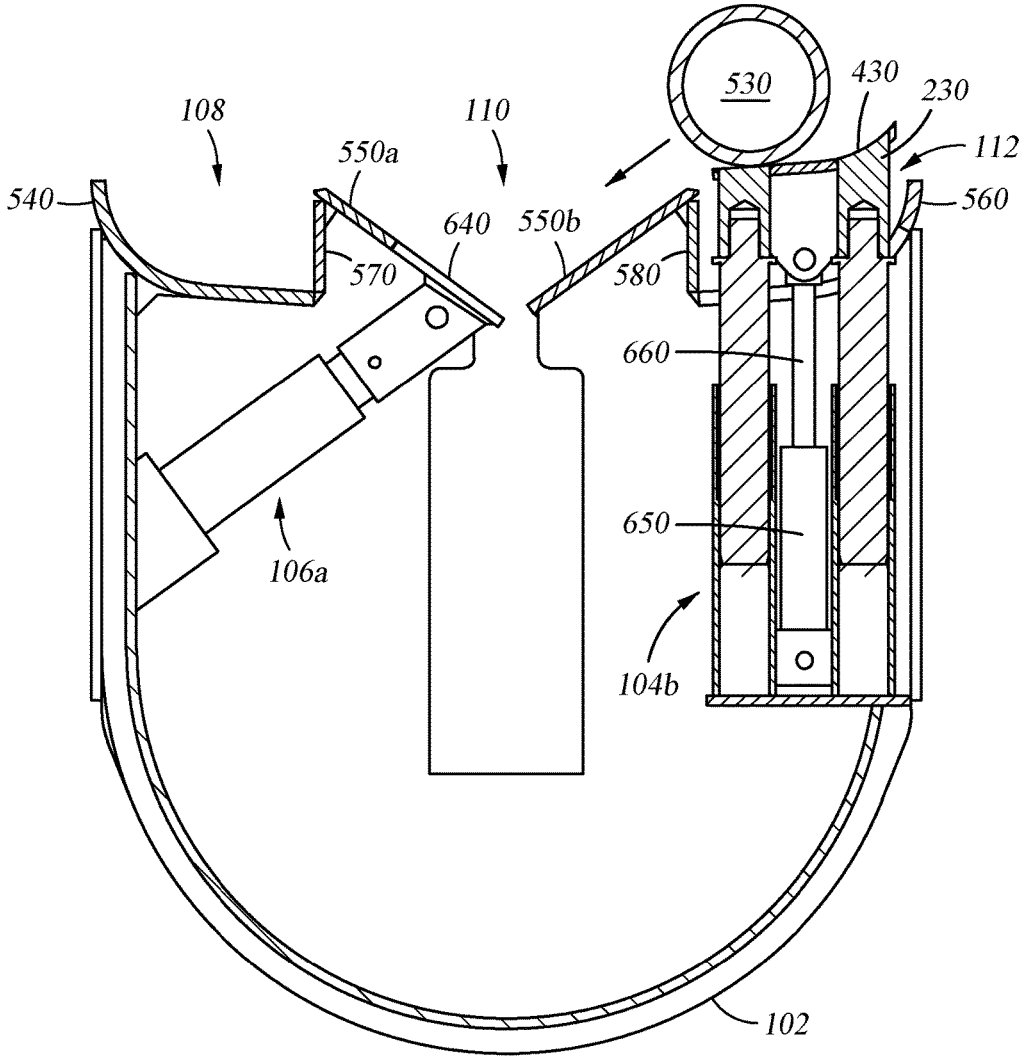
FIGS. 6A, 6B, and 6C show embodiments of a cross-section of the trough of the tubular handling system during operation of an interior kicker and a set of exterior kickers.
Figure 6B:
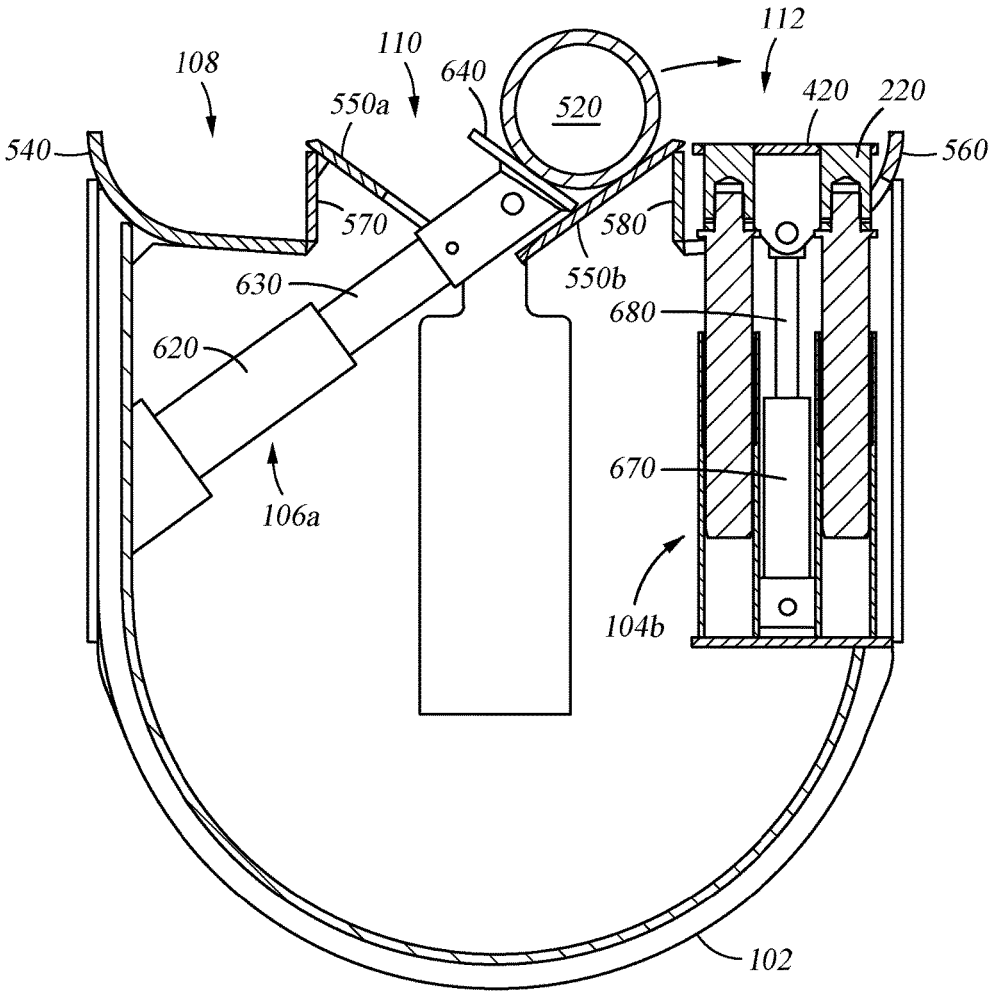
Figure 6C:
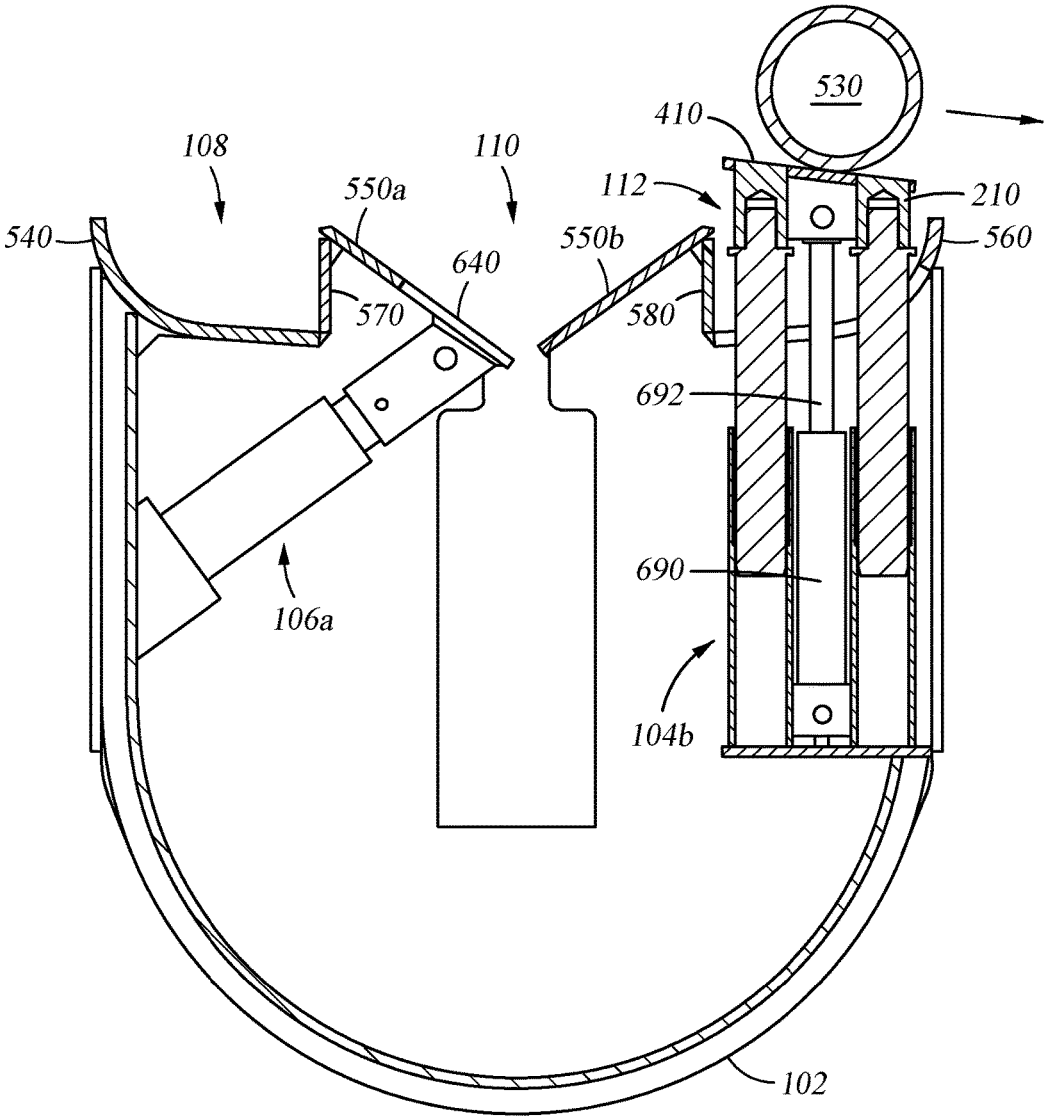

FIGS. 6A-6C illustrate loading, unloading, and transferring pipe using the kicker and transfer assembly according to one embodiment.

FIG. 6A shows an embodiment of a cross-section of the trough 102 including an interior kicker 106*a* and a set of exterior kickers 104*b*, illustrating loading the pipe 530 into the interior channel 110 of the trough 102 from the second exterior channel 112. The interior kicker 106*a* is in the retracted position, such that the shoe surface 640 of the interior kicker 106*a* lies substantially flush with the angled surface 550*a* of the interior channel 110 of the trough 102. The transfer kicker 220 and the unloader kicker 210 in the set of exterior kickers 104*b* remain in the retracted position.

The loader kicker 230 in the set of exterior kickers 104*b* is in the extended position, such that it lifts the pipe 530 in the second exterior channel 112 up above the top of the vertical surface 580. The loader kicker 230 is coupled to a linear actuator, such as a piston/cylinder assembly comprising a piston rod 660 and a cylinder body 650. Pressurized fluid may be introduced on either side of the piston rod 660 in the cylinder body 650 to extend and retract the rod 660, which is connected to the pipe receiving surface 430 of the loader kicker 230. Once the loader kicker 230 is fully extended, gravity and/or the angle and curve of the pipe receiving surface 430 cause the pipe 530 to roll down onto the surface 550*b* and into the interior channel 110.

Similar to the loading illustrated by FIG. 6A, the pipe 510 may be loaded from the first exterior channel 108 into the interior channel 110 of the trough 102 by extending the loader kicker 230 of the set of exterior kickers 104*a* in the first exterior channel 108 shown in FIG. 5C.

FIG. 6B shows an embodiment of a cross-section of a trough 102 including an interior kicker 106*a* and a set of exterior kickers 104*b*, illustrating unloading the pipe 520 from the interior channel 110 of the trough 102 to a position out of the tubular handling system, bypassing the second exterior channel 112. The transfer kicker 220 in the set of exterior kickers 104*b* is extended, while the loader kicker 230 and the unloader kicker 210 remain in the retracted position. The transfer kicker 220 is coupled to a linear actuator, such as a piston/cylinder assembly comprising a piston rod 680 and a cylinder body 670. Pressurized fluid may be introduced on either side of the piston rod 680 in the cylinder body 670 to extend and retract the rod 680, which is connected to the pipe receiving surface 420 of the transfer kicker 220.

The interior kicker 106*a* is also extended. The interior kicker 106*a* is coupled to a linear actuator, such as a piston/cylinder assembly comprising a piston rod 630 and a cylinder body 620. Pressurized fluid may be introduced on either side of the piston rod 630 in the cylinder body 620 to extend and retract the rod 630, which is connected to the shoe surface 640.

The interior kicker 106*a* is movable toward the set of exterior kickers 104*b* in a substantially inclined direction. The interior kicker 106*a* may be movable at substantially the same time as the transfer kicker 220 of the set of exterior kickers 104*b*. As the interior kicker 106*a* is extended, the shoe surface 640 of the interior kicker 106*a* pushes the pipe up the surface 550*b* toward the second exterior channel 112. Once the interior kicker 106*a* is fully extended, the pipe 520 is pushed to the top of surface 550*b* where the surface 550*b* meets the vertical surface 580.

The force from the push of the interior kicker 106*a* causes the pipe 520 to roll onto the horizontal pipe receiving surface 420 of the transfer kicker 220, which is in the extended position. The push force causes the pipe 520 to roll across the pipe receiving surface 420 of transfer kicker 220 and unloaded out of the trough 102, bypassing the second exterior channel 112.

Although the pipe 520 is shown as being unloaded in FIG. 6B, the pipe 520 may be directly loaded into the interior channel 110 from outside of the trough 102 by rolling the pipe 520 across the horizontal pipe receiving surface 420 of the transfer kicker 220 (when in the extended position) to bypass the second exterior channel 112. The pipe 520 may roll across the horizontal pipe receiving surface 420 and drop into the interior channel 110 with the interior kicker 106*a* in the retracted position. Alternatively, the interior kicker 106*a* may be in the extended position to receive the pipe 520 from the horizontal pipe receiving surface 420 of the transfer kicker 220, and then slowly retracted to lower the pipe 520 into the interior channel 110.

In one embodiment, all of the exterior kickers 104*b* may be retracted such that the pipe 520 is transferred and dropped into the second exterior channel 112 from outside of the trough 102 or from the interior channel 110 by the interior kicker 106*a*.

Similarly, the pipe 520 may be directly unloaded out of or directly loaded into the interior channel 110, bypassing the first exterior channel 108, by extending the interior kicker 106*b* and using the exterior kickers 104*a* as needed. The interior kicker 106*b* is movable toward the set of exterior kickers 104*a* in a substantially inclined direction. The interior kicker 106*b* may be movable at substantially the same time as the transfer kicker 220 of the set of exterior kickers 104*a*.

FIG. 6C shows an embodiment of a cross-section of a trough 102 including an interior kicker 106*a* and a set of exterior kickers 104*b*, illustrating unloading the pipe 530 from the second exterior channel 112 such that it exits the trough 102. The interior kicker 106*a* is in the retracted position. The unloader kicker 210 of the set of exterior kickers 104*b* is extended, while the loader kicker 230 and the transfer kicker 220 remain in the retracted position.

The unloader kicker 210 is coupled to a linear actuator, such as a piston/cylinder assembly comprising a piston rod 692 and a cylinder body 690. Pressurized fluid may be introduced on either side of the piston rod 692 in the cylinder body 690 to extend and retract the rod 692, which is connected to the pipe receiving surface 410 of the unloader kicker 210. The unloader kicker 210 lifts the pipe 530 above the surface 560 of the second exterior channel 112 of the trough 102. Due to gravity, and the angle of the pipe receiving surface 410 of the unloader kicker 210, the pipe 530 rolls out of the trough 102 to the right side of the trough 102.

Similar to the unloading illustrated by FIG. 6C, the pipe 510 may be unloaded from the first exterior channel 108 out of the trough 102 to the left side of the trough 102 by extending the unloader kicker 210 of the set of exterior kickers 104*a* in the first exterior channel 108 shown in FIG. 5C.

While the foregoing is directed to some embodiments, other and further embodiments may be devised without departing from the basic scope thereof, and the scope thereof is determined by the claims that follow.

The invention claimed is:

1. A tubular handling system, comprising:

a trough having two exterior channels and an interior channel disposed between the two exterior channels, wherein the two exterior channels and the interior channel are disposed along a longitudinal length of the trough and configured to support at least one tubular;

an exterior kicker disposed in each of the exterior channels and configured to move the tubular from one of the exterior channels to the interior channel or from one of the exterior channels to a position out of the trough; and an interior kicker disposed in the interior channel and configured to move the tubular from the interior channel to one of the exterior channels.

2. The system of claim 1, wherein the exterior kicker includes a first kicker having a pipe receiving surface that is inclined in a first direction, a second kicker having a pipe receiving surface that is substantially horizontal, and a third kicker having a pipe receiving surface that is inclined in a second direction opposite the first direction.

3. The system of claim 2, wherein the pipe receiving surfaces of the first kicker, the second kicker, and the third kicker are each independently movable relative to the trough between an extended position and a retracted position.

4. The system of claim 3, wherein the first kicker is configured to move the tubular from one of the exterior channels to the interior channel, and wherein the third kicker is configured to move the tubular from one of the exterior channels to the position out of the trough.

5. The system of claim 4, further comprising a plurality of exterior kickers disposed in each of the exterior channels and spaced apart along the two exterior channels, and a plurality of interior kickers disposed in the interior channel and spaced apart along the interior channel.

6. A tubular handling system, comprising:

a trough;

a first kicker having a pipe receiving surface that is inclined in a first direction;

a second kicker having a pipe receiving surface that is substantially horizontal; and a third kicker having a pipe receiving surface that is inclined in a second direction opposite the first direction;

wherein the first kicker, the second kicker, and the third kicker are each disposed in the trough; and wherein the pipe receiving surfaces of the first kicker, the second kicker, and the third kicker are each independently movable relative to the trough between an extended position and a retracted position.

7. The system of claim 6, wherein a portion of the pipe receiving surface of the first kicker is curved.

8. The system of claim 6, wherein the first, second, and third kickers are movable between the extended and retracted position by a linear actuator.

9. The system of claim 6, wherein the first, second, and third kickers each extend along vertical paths while maintaining engagement with a tubular.

10. The system of claim 6, wherein the trough has an exterior channel and an interior channel, and wherein the first, second, and third kickers are disposed in the exterior channel.

11. The system of claim 10, wherein the first kicker is configured to move a tubular from the exterior channel to the interior channel when in the extended position.

12. The system of claim 11, wherein the third kicker is configured to move the tubular from the exterior channel to a position out of the trough when in the extended position.

13. The system of claim 12, wherein the tubular is configured to bypass the exterior channel and roll across the second kicker when in the extended position.

14. A kicker and transfer assembly, comprising:

a trough;

a set of exterior kickers disposed in the trough and comprising:

a first kicker having a pipe receiving surface that is inclined in a first direction;

a second kicker having a pipe receiving surface that is substantially horizontal; and a third kicker having a pipe receiving surface that is inclined in a second direction opposite the first direction;

wherein the first kicker, the second kicker, and the third kicker are each independently movable in a substantially vertical direction; and an interior kicker disposed adjacent to the set of exterior kickers, wherein the interior kicker is movable toward the set of exterior kickers in a substantially inclined direction.

15. The assembly of claim 14, wherein a portion of the pipe receiving surface of the first kicker is curved.

16. The assembly of claim 14, wherein the interior kicker has a pipe receiving surface that is inclined in the same direction as the third kicker.

17. The assembly of claim 14, wherein the set of exterior kickers are movable in the substantially vertical direction by a linear actuator.

18. The assembly of claim 17, wherein the linear actuator is a piston/cylinder assembly.

19. The assembly of claim 14, wherein the trough has an exterior channel and an interior channel, wherein the set of exterior kickers are disposed in the exterior channel, and wherein the interior kicker is disposed in the interior channel.

* * * * *